United States Patent [19]

Kohler

[11] 4,031,188

[45] June 21, 1977

[54] PROCESS FOR FORMING CARBONACEOUS FIBERS

[75] Inventor: Gunter A. Kohler, Grant Township, Washington County, Minn.

[73] Assignee: Minnesota Mining and Manufacturing Company, St. Paul, Minn.

[22] Filed: Feb. 13, 1975

[21] Appl. No.: 549,785

[52] U.S. Cl. ..... 423/447.6; 8/115.5; 423/447.7; 264/29.2

[51] Int. Cl.[2] ..... D01F 9/22

[58] Field of Search ..... 423/447, 447.6, 447.7; 8/115.5; 264/29; 260/85.5 S; 528/481, 492

[56] References Cited

UNITED STATES PATENTS

| | | | |
|---|---|---|---|
| 2,758,003 | 8/1956 | Kleiner et al. | 8/115.5 |
| 3,592,595 | 7/1971 | Gump et al. | 423/447 |
| 3,632,798 | 1/1972 | Morita et al. | 260/85.5 S |
| 3,814,577 | 6/1974 | Menikheim | 423/447 X |
| 3,862,334 | 1/1975 | Turner | 423/447 |

*Primary Examiner*—Edward J. Meros
*Attorney, Agent, or Firm*—Cruzan Alexander; Donald M. Sell; James V. Lilly

[57] ABSTRACT

A method is disclosed for forming carbonaceous fibers from polyacrylonitrile fibers wherein the polyacrylonitrile is treated with an amine in a pressure vessel at an elevated temperature and an elevated pressure, oxidizing the amine treated polyacrylonitrile at an elevated temperature in an oxidizing atmosphere, and carbonizing the oxidized polyacrylonitrile by heating it at a temperature of at least 1000° C.

5 Claims, No Drawings

PROCESS FOR FORMING CARBONACEOUS FIBERS

BACKGROUND OF THE INVENTION

This invention relates to a method for producing carbon and graphite fibers. More particularly it relates to a method for producing carbon and graphite fibers from polyacrylonitrile fibers.

The need for composite materials that have high temperature strength, stiffness and toughness is well known. For example, reinforced plastics have found use in widely divergent applications such as golf club shafts, rocket tubes and heat exchangers.

One method of manufacturing such composites involves the combination of resins with carbon and graphite fibers. In addition to possessing high temperature strength, stiffness and toughness, these composites are also light weight. Frequently carbon and graphite fibers used in these composites are formed from polyacrylonitrile fibers. However, carbonization of said fibers is inherently difficult due to the occurrence of a sharp exotherm at 250° C–350° C. It is believed that the exotherm results when polyacrylonitrile changes from a linear to a cyclic structure. Fibers obtained when the exotherm occurs are often brittle and fused together. Embrittlement is also accompanied by shrinkage of the fiber dimensions (e.g. about 30 percent reduction from original fiber size).

Various attempts have been made to produce carbon and graphite, hereinafter referred to as carbonaceous, fibers. For example, U.S. Pat. No. 3,412,062 discloses the production of carbonaceous fibers from polyacrylonitrile fibers by heating them from 25° C to 1000° C at a rate of 15° C per hour in a vacuum while they are under tension. The resultant carbon fibers may then be graphitized by heating them at 2,500° C for 1 hour in an argon atmosphere. Other similar methods for the production of carbonaceous fibers from polyacrylonitrile are disclosed in U.S. Pat. Nos. 3,556,729 and 3,607,059. Each of these patents require the use of tension and slow initial heating in order to prevent the polyacrylonitrile fibers from becoming brittle or fusing together. In order to maintain the constant tension, special equipment is required. Such equipment is expensive and, consequently, designed to be utilized most economically in large scale continuous production. The resulting high cost seriously limits the utilization of carbonaceous fibers.

Another method for the production of carbonaceous fibers is disclosed in U.S. Pat. No. 3,592,595. In this method polyacrylonitrile fibers are treated with a solvent solution of a Lewis acid comprising a complex of a metal salt (e.g. tin chlorides, iron chlorides, etc.), and dimethyl formamide to form a stabilized product that can in turn be converted to carbonaceous fibers by heating it to at least 1,000° C. The metal salts used in this method are expensive. Moreover, large quantities of solvent are necessary in order to form the complex and prepare the solution thereby further increasing the cost of this method and introducing the additional concerns of health, safety and the ecology.

The present invention solves these and other disadvantages attendant with the prior art thereby producing relatively inexpensive carbonaceous fibers. Moreover, the present invention allows preparation of the carbonaceous fibers to be interrupted at any stage of the process without affecting either the intermediate or final products of the process. Furthermore, the intermediate products can be stored for long periods of time (e.g. several months or more) without affecting the final product.

SUMMARY OF THE INVENTION

The method disclosed herein produces stabilized polyacrylonitrile fibers as well as lower cost carbonaceous fibers. In accordance with the present invention, there is provided a method of forming carbonaceous fibers comprising the steps of:

a. substantially cyclizing polyacrylonitrile fibers by treating said fibers with an amine compound at elevated temperature and elevated pressure; and b. oxidizing the substantially cyclized fibers in an oxidizing atmosphere at an elevated temperature; and c. carbonizing the oxidized fibers by heating said fibers to at least 1000° C in an inert atmosphere.

The substantially cyclized polyacrylonitrile fibers are characterized by a significantly lower exotherm (e.g. a change in enthalpy, $\Delta H$, of less than about 350 cal/gm) after they have been treated with amine. Consequently, carbonaceous fibers are produced with significantly less shrinkage (e.g. about 10 percent) than in the prior art processes and with minimal fusion. The present invention also provides a method for the production of carbonaceous fibers without the need for placing the polyacrylonitrile fibers under tension. Moreover, it provides a method wherein small and large quantities of carbonaceous fibers may be produced relatively inexpensively.

DETAILED DESCRIPTION OF THE INVENTION

The method of the present invention comprises the steps of treating polyacrylonitrile fibers, or yarn, with an amine to substantially cyclize or stabilize them, oxidizing the stabilized fibers, and carbonizing the oxidized fibers. The polyacrylonitrile fibers can be wound on spools or drums, or placed as loose hanks or coils on a support during the procedure. Preferably, the fibers are heated to about 220° C to remove water from their surface prior to commencing cyclization. However, this is not necessary to production of suitable fibers.

Cyclization, and consequent stabilization, of the fibers is carried out by placing them in a pressure vessel, such as an autoclave, introducing a catalytic amount of an amine therein, raising the temperature and pressure thereof to from about 130° C to 200° C and to from about 3.5 to 70 kg/cm$^2$ respectively, and maintaining these conditions for from about 16 to 60 hours, and preferably from about 20 to 40 hours. Pressure may be maintained throughout cyclization by means of the amine or, alternatively, by means of a mixture of the amine and an inert gas such as nitrogen, argon, xenon, etc. As stabilization proceeds, the structure of the fibers is rearranged and their infrared spectra changes. The 2245 cm$^{-1}$ band characteristic of the C N bond of uncyclized polyacrylonitrile disappears while the 1623 cm$^{-1}$ band characteristic of the C=N conjugated double bond of cyclized polyacrylonitrile appears. When substantial cyclization is complete, the 2245 cm$^{-1}$ band is substantially gone and the repeating unit of the resultant rearrangement product has the structure wherein $n$ depends on molecular weight of the polymer:

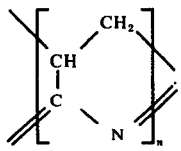

(I.)

or

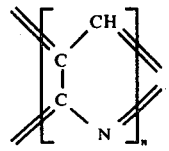

(II.)

The repeating unit I results when stabilization is carried out in an inert atmosphere while the repeating II results when stabilization is carried out in an oxygen containing atmosphere (e.g. air).

After cyclization, the fibers have a color that may vary from yellowish brown to golden brown. Additionally, they have significantly lower exotherm (e.g. ΔH of less than about 350 cal/gm), do not shrink significantly, are not fragile and do not significantly fuse together. In contrast, polyacrylonitrile that has not been cyclized exhibits a much larger exotherm (e.g. ΔH of at least 640 cal/gm) and results in fibers that shrink significantly, are fragile and fuse together. The method used to measure the exotherm is described below.

Amines useful in the practice of this invention are Lewis bases and may be represented by the general formula:

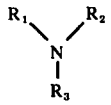

wherein $R_1$, $R_2$ and $R_3$ may be the same or different and comprise the group consisting of hydrogen and lower alkyl groups having from 1 to 4 carbon atoms. The amines are readily vaporizable having a normal boiling point of 60° C or less at standard pressure (760 Torr). Additionally, they have a $pK_b$ of about 6 or less. Amines having higher $pK_b$ values are not basic enough for effective cyclization. Preferably, the amine have a $pK_b$ of 5 or less. Representative examples of suitable amines include ammonia, methylamine, dimethylamine, trimethylamine, ethylamine, diethylamine, n-propylamine, isopropylamine and t-butylamine. Other amines useful in the present invention of the type described are known to the art.

As substantially all the amine added during cyclization is recovered, it is believed that the amine acts as a catalyst. Consequently, the amount of amine necessary in the practice of this invention is small. It may vary from about 3 to 50 grams per liter of volume of the pressure vessel. Higher concentration of amine results in lower cyclization temperatures or shorter cyclization times than do lower concentrations of amine.

Once cyclization has been completed, the fibers are oxidized at an elevated temperature (e.g. 250°–350° C) in an oxidizing atmosphere (e.g. air) at atmospheric pressure. Generally, the temperature of the fibers is raised to about 250° C–350° C over a period of from about 4 to 20 hours. Shorter oxidizing cycles are possible such as by raising the temperature of the fibers to 250° C–300° C in about 1 hour and then placing them in an oven maintained at 330° C to 350° C for 3 to 4 hours. Another oxidizing cycle involves heating the the cyclized fibers to 250° C–300° C in a few minutes and then maintaining that temperature for about 16 hours.

The oxidized fibers are carbonized in an inert atmosphere (e.g. nitrogen, argon, xenon, etc.) by being fed continuously through a furnace maintained at 1000° C to 2300° C. The residence time of the fiber in the furnace may be varied from about 3 to 30 seconds. Carbonization at temperatures up to about 2000° C results in the production of essentially carbon (e.g. amorphous) fibers. Carbonization at temperatures above 2000° C results in the production of graphite (e.g. crystalline) fibers.

Exotherm data were obtained by means of Differential Scanning Calorimetry measurements using a "DSC-2" Differential Scanning Calorimeter commercialy available from the Perkin-Elmer Company, Norwalk, Conn. The calorimeter was first calibrated by placing a small known amount (e.g. 5–25 mg) of highly purified metallic indium in the heating chamber of the calorimeter. The temperature of the indium and the calorimeter was raised from room temperature (e.g. about 25° C) at a uniform rate of 10° C/min by means of electrical energy. At about 155° C a phase change occurred in the indium resulting in a temperature differential between it and the calorimeter. This differential was plotted against the temperature of the calorimeter and the area under the resulting curve represented the known change in enthalpy of indium. The magnitude of the exotherm (e.g. the change in enthalpy) of cyclized or uncyclized polyacrylonitrile fibers was determined in the same manner. The exotherm occurred at about 300° C–340° C.

The following examples are meant to further illustrate, but not limit, the invention.

EXAMPLE 1

Polyacrylonitrile yarn (0.45 kg, 2000 filaments, total denier of 3100, 0.394 twist per cm) was cyclized in a 3 liter autoclave. Nitrogen was used as an inert atmosphere for samples D and E. An inert atmosphere was not used for the remainder of the samples. The exotherm of the resultant fibers was measured and compared with that of uncyclized polyacrylonitrile. The conditions used and results obtained are given in Table I.

TABLE I

| Sample | Amount | Type | Press (kg/cm²) | Autoclave Temp (° C) | Time (hr) | Exotherm (cal/gm) |
|---|---|---|---|---|---|---|
| A | 20gm | $NH_3$ | 11.95 | 160 | 40 | 210 |
| B | 20gm | $NH_3$ | 11.25 | 170 | 20 | 230 |
| C | 9gm | $NH_3$ | 4.57 | 160 | 40 | 330 |
| D | 10gm | $CH_3NH_2$ | 11.25 | 170 | 40 | 230 |
| E | 20gm | $(CH_3)_3N$ | 11.95 | 160 | 40 | 300 |
| F | uncyclized polyacrylonitrile | | | — | — | 640–660 |

The significant reduction in exotherm (e.g. ΔH of less than about 350 cal/gm) shows that cyclization in the presence of an amine compound stabilizes the polyacrylonitrile.

EXAMPLE 2

A continuous length of 2000 filaments of polyacrylonitrile yarn having a total denier of 3100 and 0.394 twist per centimeter was wound on an aluminum spool (33 cm long by 3.8 cm in diameter) to a depth of approximately 2.5 cm.

The spool and yarn were placed in a 3 liter autoclave and the autoclave evacuated for 30 minutes. Seventy grams of ammonia gas were introduced into the autoclave at −78° C and the autoclave warmed to 50° C. Nitrogen was added to bring the total pressure up to about 70 kg/cm². The autoclave was maintained at these conditions for 15 hours and then heated slowly to 170° C, the pressure being held constant at 70 kg/cm² by gas release. The resulting cyclized polyacrylonitrile fibers had a golden brown color in contrast to their original clear color and could be unwound from a spool without difficulty.

The separation of the individual fibers from the spool was accomplished by sliding the stabilized yarn over an aluminum rod.

Ten grams of the stabilized fibers were placed in an open dish and heated at 290° C in an air atmosphere in a muffle furnace for 16 hours. The resulting oxidized yarn was black in appearance and retained its original fibrous configuration.

The oxidized yarn was continuously introduced into a vertical 450 kilocycle (kc) induction furnace maintained under an argon atmosphere. The temperature of the furnace was approximately 1200° C, the yarn being passed through the furnace in approximately 15 seconds. The resulting yarn had a total denier of 1850 and a density of 1.77 gm/cm³.

Tests on individual fibers showed an average single filament tenacity of 16.5 grams per denier or tensile strength of $2.56 \times 10^4$ kg/cm². Young's modulus values were determined using the resonance frequency technique and the values averaged about $1.69 \times 10^6$ kg/cm².

Another sample of oxidized fibers was passed through the induction furnace at a temperature of approximately 2300° C. The fibers were in the furnace for about 7 seconds. The resulting graphitized single fibers exhibited a tenacity of 12.7 grams per denier and a tensile strength of $1.79 \times 10^4$ kg/cm². The Young's modulus was about $3.44 \times 10^6$ kg/cm².

EXAMPLE 3

Twenty grams of the fibers of Example 2 were carbonized by passing them through an electrically heated horizontal tube furnace under a nitrogen atmosphere. The hot zone of the furnace was 30 cm long and 2.5 cm in diameter. The yarn was pulled through continuously and had a contact time of 24 seconds at 1200° C. The resulting black yarn had an average tensile strength of $1.67 \times 10^4$ kg/cm². The Young's modulus was $1.72 \times 10^6$ kg/cm².

When the fibers were in the furnace for a total contact time of only 12 seconds, their average tensile strength was $1.85 \times 10^4$ kg/cm² while the Young's modulus was $1.69 \times 10^6$ kg/cm².

EXAMPLE 4

Polyacrylonitrile yarn (450 gm) was wound on an aluminum spool (33 cm long by 3.8 cm diameter), placed in a 3-liter autoclave and heated under vacuum at 130° C for 16 hours to remove water absorbed on the yarn. Approximately 20 grams of ammonia were then introduced into the autoclave and heated to 165° C which resulted in the pressure rising to 12 kg/cm². These conditions were maintained for 40 hours. Differential thermal analysis showed the fibers did not have a significant exotherm after treatment in the above manner. Differential thermal analysis was performed by using a "Differential Thermalyzer" Model 260P commercially available from Fisher Scientific Instruments. Measurements were made by placing about 5–25 mg of polyacrylonitrile fibers and a thermocouple into a glass tube. Another thermocouple was placed into an empty glass tube. Both glass tubes were then placed into a heating block and the temperature of the block was raised from room temperature (e.g. 25° C) at a uniform rate of 10° C/min. At about 300° C–340° C the fibers exothermed slightly resulting in a temperature differential between the two thermocouples. The differential was plotted against the temperature of the heating block and the resultant curve was then observed. The plot showed only a small area under the curve indicating a relatively small exotherm.

The resulting cyclized fibers had a golden brown color. They were pulled continuously through a horizontal tube furnace maintained at 250° C in an air atmosphere to partially oxidize them. The fibers were in the furnace for about 30 minutes.

The resulting partially oxidized fibers were then piled loosely in a dish and further oxidized at 290° C for 16 hours in a muffle air furnace.

Carbonization was carried out as described in Example 3 by heating the oxidized fibers in a nitrogen atmosphere at 1200° C for a total time of about 30 seconds. The carbonized fibers were black and retained their original configuration. The fibers had a tensile strength of $1.93 \times 10^4$ kg/cm. The Young's modulus of the fibers was $2.2 \times 10^6$ kg/cm².

EXAMPLE 5

A sample (20 grams) of loose polyacrylonitrile fibers was placed in a one-liter beaker and subjected to a temperature of 170° C at a pressure of 13.0 kg/cm² of ammonia for 40 hours to form a yellowish brown yarn. Differential thermal analysis of a portion of the fibers showed no significant exotherm, indicating a substantial cyclization.

About 10 grams of the cyclized fibers were oxidized in a vented muffle furnace at 290° C for 16 hours in an air atmosphere. The fibers were then carbonized by continuously passing them through a 450 kc induction furnace maintained at 1200° C under an argon atmosphere. The oxidized fibers were exposed to the 1200° C temperature for about 7 seconds.

The resulting carbonized fibers had a tensile strength of about $1.93 \times 10^4$ kg/cm² and a Young's modulus of about $1.97 \times 10^6$ kg/cm².

What is claimed is:

1. A method of forming carbonaceous fibers consisting essentially of the steps of:

a. substantially cyclizing polyacrylonitrile fibers by treating said fibers with a catalytic quantity of a gaseous form of an amine compound at elevated temperature and elevated pressure, wherein said amine compound has the formula:

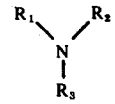

wherein $R_1$, $R_2$ and $R_3$ may be the same or different and comprise the group consisting of hydrogen and lower alkyl groups having from one to four carbon atoms, and wherein said amine has a boiling point of 60° or less at standard pressure (760 TORR) and a $pK_b$ of about 6 or less; and b. oxidizing the substantially cyclized fibers in an oxidizing atmosphere at an elevated temperature; and c. carbonizing the oxidized fibers by heating said fibers to at least 1000° C. in an inert atmosphere.

2. A method according to claim 1 wherein said polyacrylonitrile fibers are treated with said amine compound at a temperature of from about 130° C. to 200° C. and a pressure of from about 3.5 to 70 kg/cm$^2$; and wherein said cyclized fibers are oxidized in an oxidizing atmosphere at a temperature of from about 250° C. to 350° C; and wherein said oxidized fibers are carbonized by heating said fibers to at least 1000° C. in a nitrogen atmosphere.

3. A method according to claim 2 wherein said amine is ammonia.

4. A method according to claim 2 wherein said oxidizing atmosphere is air.

5. A method according to claim 2 wherein said carbonizing is carried out at a temperature of at least 2000° C.

* * * * *

UNITED STATES PATENT AND TRADEMARK OFFICE

CERTIFICATE OF CORRECTION

PATENT NO. : 4,031,188

DATED : June 21, 1977

INVENTOR(S) : GUNTER A. KOHLER

It is certified that error appears in the above-identified patent and that said Letters Patent are hereby corrected as shown below:

Col. 2, line 59, "C N bond" should read -- C≡N bond --.

Col. 3, line 42, "amine" should read -- amines --.

Signed and Sealed this

First Day of November 1977

[SEAL]

*Attest:*

RUTH C. MASON
*Attesting Officer*

LUTRELLE F. PARKER
*Acting Commissioner of Patents and Trademarks*